US009986601B2

(12) United States Patent
Minamiya

(10) Patent No.: US 9,986,601 B2
(45) Date of Patent: May 29, 2018

(54) WINDOW GLASS FOR VEHICLE AND MOUNTING STRUCTURE FOR SAME

(71) Applicant: ASAHI GLASS COMPANY, LIMITED, Tokyo (JP)

(72) Inventor: Yuukou Minamiya, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 354 days.

(21) Appl. No.: 14/694,381

(22) Filed: Apr. 23, 2015

(65) Prior Publication Data

US 2015/0230292 A1 Aug. 13, 2015

Related U.S. Application Data

(63) Continuation of application No. PCT/JP2013/078873, filed on Oct. 24, 2013.

(30) Foreign Application Priority Data

Oct. 25, 2012 (JP) ..... 2012-235790

(51) Int. Cl.
*H05B 3/84* (2006.01)
*H05B 3/86* (2006.01)
*H01Q 1/12* (2006.01)

(52) U.S. Cl.
CPC ..... *H05B 3/84* (2013.01); *H01Q 1/1278* (2013.01); *H05B 3/86* (2013.01);
(Continued)

(58) Field of Classification Search
None
See application file for complete search history.

(56) References Cited

U.S. PATENT DOCUMENTS 5,231,410 A * 7/1993 Murakami ..... H01Q 1/1278 343/704
5,933,119 A * 8/1999 Fujii ..... H01Q 1/1278 343/704

(Continued)

FOREIGN PATENT DOCUMENTS

EP 0 856 904 A2 8/1998
EP 0 856 904 A3 8/1998

(Continued)

OTHER PUBLICATIONS

Extended European Search Report dated Apr. 11, 2016 in Patent Application No. 13849339.0.

(Continued)

*Primary Examiner* — Joseph M Pelham
(74) *Attorney, Agent, or Firm* — Oblon, McClelland, Maier & Neustadt, L.L.P.

(57) ABSTRACT

To provide a vehicle window glass, in which heater wires and a conductor wire, such as an antenna, intersect, and a mounting structure for the window glass for a vehicle. The heater wires are not noticeable and have a good appearance. A window glass for a vehicle, comprising a glass main body, a plurality of heater wires formed to extend in a horizontal direction when mounted to a vehicle, and an antenna wire formed to intersect at least one of the heater wires, wherein the smallest line width "a" of the heater wires is at most 0.4 mm, and the largest line width "b" of the antenna wire is smaller than the line width "a" in a range of intersection of the antenna wire and the heater wires extending from one end of the antenna wire to the other end of the antenna wire.

20 Claims, 6 Drawing Sheets

(52) U.S. Cl.
CPC .. *H05B 2203/005* (2013.01); *H05B 2203/011* (2013.01); *H05B 2203/013* (2013.01); *H05B 2203/017* (2013.01); *Y10T 403/47* (2015.01)

(56) References Cited

U.S. PATENT DOCUMENTS 5,952,977 A * 9/1999 Taniguchi ..... H01Q 1/1278 343/704
6,002,373 A * 12/1999 Taniguchi ..... H01Q 1/1278 343/704
6,072,435 A 6/2000 Terashima et al.
6,243,043 B1 6/2001 Terashima et al.
6,396,445 B1 * 5/2002 Saitoh ..... H01Q 1/1278 343/704
8,586,894 B2 * 11/2013 Igura ..... H01Q 1/1271 219/202
2001/0054982 A1 * 12/2001 Tabata ..... H01Q 1/1278 343/713
2005/0030235 A1 * 2/2005 Noguchi ..... H01Q 1/1278 343/713
2007/0273597 A1 * 11/2007 Noda ..... H01Q 1/1271 343/713
2009/0096690 A1 * 4/2009 Shimo ..... H01Q 1/1271 343/713
2009/0166347 A1 * 7/2009 Blanchard ..... B32B 17/10036 219/201
2010/0141539 A1 * 6/2010 Thole ..... H01Q 3/247 343/703
2010/0309065 A1 * 12/2010 Kuehne ..... H01Q 1/32 343/704
2010/0321258 A1 * 12/2010 Lankes ..... H01Q 1/1278 343/712
2010/0321259 A1 * 12/2010 Tabata ..... H01Q 1/1278 343/713
2010/0328170 A1 * 12/2010 Kuehne ..... H01Q 1/1278 343/712
2011/0032163 A1 * 2/2011 Noguchi ..... H01Q 9/42 343/711
2011/0115681 A1 * 5/2011 Oshima ..... H01Q 1/1278 343/713
2011/0233182 A1 * 9/2011 Baranski ..... H05B 3/86 219/203
2013/0057439 A1 * 3/2013 Tabata ..... H01Q 1/1278 343/713
2015/0102023 A1 * 4/2015 Mitsuhashi ..... H05B 3/20 219/203
2016/0268670 A1 * 9/2016 Kobayashi ..... H01Q 1/1278

FOREIGN PATENT DOCUMENTS

| | | |
|---|---|---|
| EP | 2 299 538 A1 | 3/2011 |
| FR | 2 818 087 A1 | 6/2002 |
| JP | 10-079615 | 3/1998 |
| JP | 2000-013121 | 1/2000 |
| JP | 2003-087026 | 3/2003 |
| JP | 2003-531461 | 10/2003 |
| JP | 2004-096773 | 3/2004 |
| JP | 2011-019081 | 1/2011 |
| JP | 2011-505311 | 2/2011 |

OTHER PUBLICATIONS

International Search Report dated Jan. 28, 2014 in PCT/JP2013/078873, filed Oct. 24, 2013.

* cited by examiner

WINDOW GLASS FOR VEHICLE AND MOUNTING STRUCTURE FOR SAME

TECHNICAL FIELD

The present invention relates to a window glass for a vehicle and a mounting structure for it.

BACKGROUND ART

On the surface in the car interior side of a window glass for a vehicle to be mounted to a vehicle e.g. as a rear glass of an automobile, heater wires constituting a defogger for defogging or a deicer for deicing, and conductor wires such as an antenna wire for radio receiving and an antenna wire for reducing noises in radio receiving may be provided in a predetermined pattern.

The defogger and the deicer may be constituted, for example, by a plurality of heater wires (wire portion) formed to extend in a horizontal direction when mounted to a vehicle and bus bars having feeding points (terminal connection portion) to supply electricity to the heater wires, connected to both ends of the respective heater wires. Further, an antenna is constituted, for example, by an antenna wire (wire portion) for receiving radio signals, a terminal connection portion to connect an exterior antenna circuit to the antenna wire, and an antenna wire (wire portion) for reducing noises and formed to intersect the heater wires.

The heater wires and the antenna wires are required to have a line width as small as possible, for the purpose of securing a favorable field of view from the car interior and achieving a good appearance.

For example, a window glass for a vehicle having heater wires and an antenna wire of about 0.3 mm formed on a surface of the window glass by screen printing has been known (for example, Patent Documents 1 and 2).

PRIOR ART DOCUMENTS

Patent Documents

Patent Document 1: JP-A-2003-531461
Patent Document 2: JP-A-2011-505311

DISCLOSURE OF INVENTION

Technical Problem

The heater wires and the antenna wire formed to intersect the heater wires are usually formed by screen printing to have the same line width, or the antenna wire is formed to have a larger line width. However, according to studies by the present inventor, it was found that if the heater wires and a conductor wire such as the antenna wire intersecting the heater wires are made thin with the same line width, the conductor wire intersecting the heater wires tends to be noticeable, thus leading to a poor appearance.

Under these circumstances, the object of the present invention is to provide a window glass for a vehicle of which heater wires and a conductor wire intersecting the heater wires are less noticeable and which has a good appearance, and a mounting structure for the window glass for a vehicle.

Solution to Problem

The window glass for a vehicle of the present invention is a window glass to be mounted to a vehicle, comprising:

a glass main body, a plurality of heater wires formed to extend in a horizontal direction on an interior surface of the glass main body when mounted to the vehicle, and a conductor wire formed to intersect at least one of the heater wires;

wherein the smallest line width "a" of the heater wires is at most 0.4 mm; and the largest line width "b" of the conductor wire within a range of intersection of the conductor wire and the heater wires is smaller than the line width "a".

According to another embodiment of the window glass for a vehicle of the present invention, the conductor wire is an antenna wire, and the line width "b" of the antenna wire is preferably at most 0.2 mm.

Further, the conductor wire is preferably an antenna wire formed to intersect the plurality of heater wires so as to connect isopotential points of the heater wires.

Further, it is preferred that as the conductor wire, two or more antenna wires to intersect the heater wires are formed, and at least two of such antenna wires are located at a distance within 300 mm from a center point of a width in the horizontal direction of the glass main body.

According to another embodiment of the window glass for a vehicle of the present invention, a condition of the following formula (1) is preferably further satisfied:

$$b \leq 0.7a \quad (1)$$

Further, the line width "a" is preferably at least 0.1 mm.

Further, the window glass for a vehicle is preferably a window glass for a vehicle to be used for a rear glass of an automobile.

Further, the line width "a" is preferably the smallest line width of the heater wires intersecting the conductor wire.

The line width "b" is preferably at least 0.07 mm.

A mounting angle θ to the vehicle body is preferably at most 30°.

A mounting structure for the window glass for a vehicle according to one embodiment of the present invention is a mounting structure, wherein the window glass for a vehicle of the present invention is used as at least one member selected from the group consisting of a windshield, a rear glass, a side glass and a roof glass of an automobile, and it is mounted to an opening of an automobile by means of a resin molding.

Advantageous Effects of Invention

The window glass for a vehicle of the present invention has the good appearance since the heater wires and the conductor wire intersecting the heater wires are less noticeable.

Further, according to the present invention, it is possible to provide the mounting structure for the window glass for a vehicle, wherein the window glass for a vehicle of which the heater wires and the conductor wire intersecting the heater wires are less noticeable and which has the good appearance, is mounted to an opening of an automobile.

DESCRIPTION OF EMBODIMENTS

In this specification, the horizontal direction in the window glass for a vehicle means the horizontal direction when the window glass for a vehicle is mounted to a vehicle.

<Window Glass for Vehicles>

Now, as one embodiment of the window glass for a vehicle of the present invention, a window glass 1 for a vehicle shown in FIG. 1 to be used as the rear glass of an automobile will be described.

Figure 1:
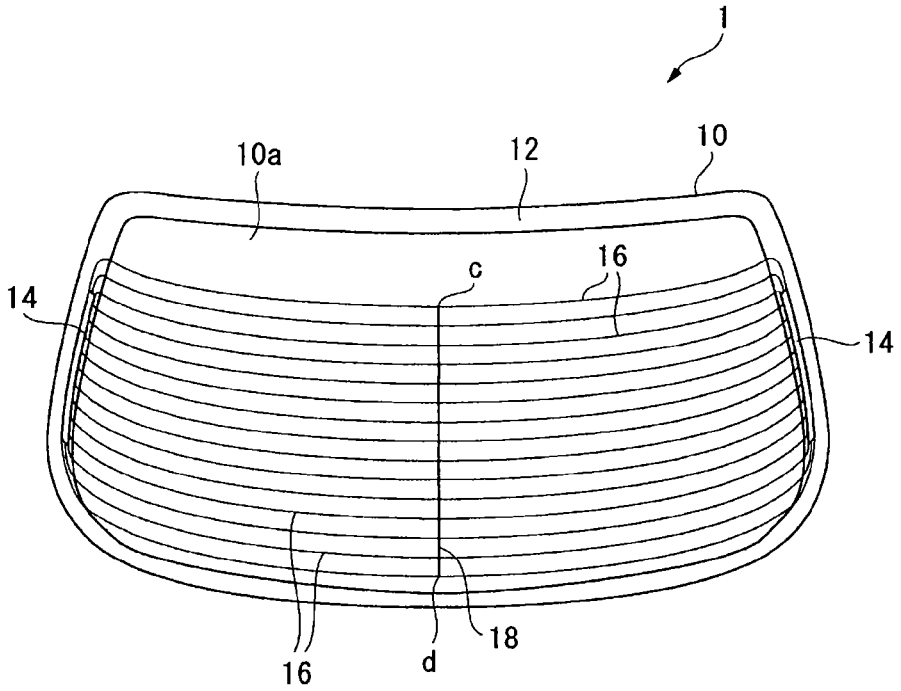
FIG. 1 is a front view illustrating one embodiment of the window glass for a vehicle of the present invention as seen from the vehicle interior side.
Figure 2:
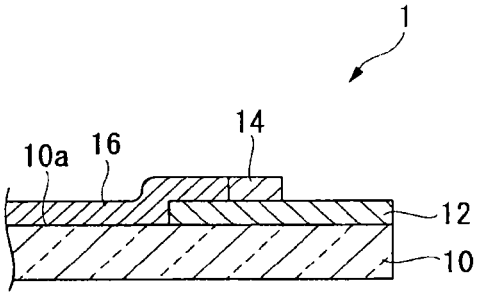
FIG. 2 is a cross sectional view illustrating the embodiment of the window glass for a vehicle as shown in FIG. 1 cut at a side edge portion in the horizontal direction.

The window glass 1 for a vehicle according to this embodiment is, as shown in FIGS. 1 and 2, the window glass to be mounted to the rear side of the automobile, and comprises a glass main body 10, a frame-form black ceramic portion 12 formed at a peripheral portion of an interior surface 10*a* when the window glass 1 is mounted to the automobile (hereinafter referred to as "vehicle interior surface 10*a*"), two bus bars 14 formed on the surface of both end portions in the horizontal direction of the black ceramic portion 12, a plurality of heater wires 16 formed to extend in the horizontal direction in the vehicle interior surface 10*a* of the glass main body 10, and one antenna wire (conductor wire) 18 formed at the center in the horizontal direction so as to intersect the heater wires 16.

Each heater wire 16 is connected to the two bus bars 14 at its both ends. To each bus bar 14 (the vehicle interior side), a metal connection terminal (not shown) is soldered. The connection terminal is connected to an external power source (not shown). Electricity is supplied to each heater wire 16 from a position (terminal connection portion) connected to the connection terminal on each bus bar 14 as a feeding point, whereby the heat wires 16 generate heat. By such heater wires, a defogger for defogging, the deicer for deicing, etc. are formed.

As the glass main body 10, a known glass plate to be disposed for a window of a vehicle may be used.

The shape of the glass main body may, for example, in the case of a rear glass for an automobile, be a substantially trapezoidal shape curved by bending so that the vehicle interior surface 10*a* side is concave.

The glass main body 10 may be a glass plate having a known glass composition such as soda lime glass, and preferred is heat ray-absorbing glass having a high iron content (blue glass or green glass).

As the glass main body 10, a tempered glass plate may be used to increase the safety. As the tempered glass plate, a tempered glass plate obtainable by an air-cooling tempering method or a chemical tempering method may be used. Further, as the glass main body 10, not only tempered glass obtained by tempering inorganic glass but also laminated glass having two glass plates bonded by a resin film, organic resin glass comprising an organic resin, or a composite material thereof, may also be used.

The black ceramic portion 12 is a portion formed by printing a black ceramic paste on the peripheral portion of the vehicle interior surface 10*a* of the glass main body 10, followed by firing. The window glass 1 for a vehicle is mounted to an opening of an automobile by means of an adhesive at a portion of the black ceramic portion 12, and deterioration of the adhesive is suppressed by the black ceramic portion 12.

Each bus bar 14 is a layer formed by a conductor, and has a role to supply electricity to each of the plurality of heater wires 16.

The specific resistance of each of conductor layers forming the bus bars 14, the heater wires 16 and the conductor wire such as the antenna wire 18 may be adjusted by properly selecting the content of a silver powder described hereinafter, the average particle size of the silver powder, addition of a resistance-adjusting agent, firing conditions, etc.

The specific resistance of the conductor layer is obtained from the following formula (2) by measuring the electric resistance (Ω) of the conductor layer formed in a wire-form with a length of 200 mm.

$$\text{Specific resistance } (\mu\Omega\text{cm}) = \{\text{electric resistance } (\Omega) \times \text{cross section } (m^2) \text{ of conductor layer formed in a wire-form} \times 10^8\} / \{\text{length (i.e. 0.2 m) of the wire portion}\} \quad (2)$$

The conductor layer may be formed, for example, by printing a paste for forming a conductor layer containing a silver powder, glass frit and as the case requires, a vehicle and additives (hereinafter referred to as "silver paste"), followed by firing.

The silver powder is particles of silver or a silver alloy.

The average particle size of the silver powder is preferably from 0.1 to 10 μm, more preferably from 0.1 to 7 μm. When the average particle size of the silver powder is within the above range, the specific resistance of the conductor layer will readily be adjusted to be within the above range. The average particle size of the silver powder means the average particle size (D50) measured by a laser scattering type particle size distribution meter.

The glass frit may, for example, be $Bi_2O_3$—$B_2O_3$—$SiO_2$ glass frit or $B_2O_3$—$SiO_2$ glass frit.

The vehicle may, for example, be a resin solution having a binder resin such as an ethyl cellulose resin, an acrylic resin or an alkyd resin dissolved in a solvent such as a-terpineol, butyl carbitol acetate or ethyl carbitol acetate.

The additives may, for example, be a resistance-adjusting agent (such as Ni, Al, Sn, Pt or Pd) or a colorant (such as V, Mn, Fe, Co, Mo or a compound thereof).

The content of the silver powder in the conductor layer (100 mass %) is preferably from 65 to 95 mass %, more preferably from 75 to 95 mass %, further preferably from 80 to 95 mass %. The specific resistance of the conductor layer will readily be adjusted to be within the above range when the content of the silver powder is within the above range.

The content of the glass frit in the conductor layer (100 mass %) is preferably from 2 to 10 mass %, more preferably from 3 to 8 mass %. The conductor layer is likely to be sintered when the content of the glass frit is at least the lower limit of the above range. Further, the specific resistance of the conductor layer will readily be adjusted to be within the above range when the content of the glass frit is at most the upper limit of the above range.

The content of the vehicle in the silver paste (100 mass %) for forming the conductor layer is preferably from 10 to 30 mass %, more preferably from 15 to 25 mass %.

The content of the additives in the conductor layer (100 mass %) is preferably at most 2 mass %, more preferably at most 1 mass %.

The average line width in the present invention means the average value of line widths measured at two or more measurement points. Further, the line width in the present invention is measured by a magnifying glass and a microscope. The average line width and the method for measuring the line width are the same for the heater wires 16 and the antenna wire 18.

The heater wires 16 are conductor layers in a wire-form formed by a conductor, generate heat by power supply from the bus bars 14, and have a function of defogging, deicing, etc.

The number of the heater wires 16 may properly be selected depending upon the area to be defogged of the window glass 1 for a vehicle when mounted to a vehicle and the interval of the heater wires, and is preferably at least 2, and in the case of a rear glass for a vehicle such as a common passenger car, more preferably at least 10, further preferably from 15 to 25.

When the number of the heater wires 16 is within the above range, the interval of the heater wires 16 is preferably from 10 to 50 mm, more preferably from 19 to 36 mm. When the interval of the heater wires 16 is at most the upper limit of the above range, a decrease in the defogging performance by a necessary heat generation amount not being obtained due to a too small number of the heater wires 16 tends to be suppressed. When the interval of the heater wires 16 is at least the lower limit of the above range, a decrease in the visibility and the completeness in the outer appearance design (so-called good appearance) due to a too large number of the heater wires 16 tends to be suppressed.

The average line width of the respective heater wires 16 is determined by the require power density and heat generation amount and is preferably from 0.05 to 1.0 mm, more preferably from 0.1 to 0.4 mm, further preferably from 0.15 to 0.3 mm.

The average line width of the heater wires 16 is preferably such that the difference with the after-mentioned smallest line width "a" is small, whereby the dispersion of the line width is small and a good appearance will be achieved.

Formation by e.g. screen printing tends to be easier, and control of the heat generation amount tends to be easier since the electric resistance of the heater wires 16 is not too high, as the maximum line width of the heater wires 16 is larger. The thin wires tend to be hardly recognized from the vehicle interior side and the completeness in the outer appearance design of the window glass 1 for a vehicle tends to improve, as the maximum line width of the heater wires 16 is smaller. Further, the electric resistance tends to be high, and the heater wires 16 will be able to generate heat to a higher temperature, as the line width of the heater wires 16 is narrower.

The thickness of the heater wires 16 is preferably from 5 to 30 μm, more preferably from 13 to 26 μm. When the thickness of the heater wires 16 is at least the lower limit of the above range, the resistance will not be too high, the heat generation amount will be properly controlled, and the loss in the electric energy will be reduced. When the thickness of the heater wires 16 is at most the upper limit of the above range, such heater wires 16 may be formed by screen printing once, and they can be formed at a low cost with a stable quality, and the resistance will easily be maintained properly.

The antenna wire 18 is a conductor layer in a wire-form formed by a conductor, is formed to intersect the plurality of heater wires 16 so as to connect isopotential points of the respective heater wires 16, is formed so that the antenna wire 18 itself does not generate heat, and has a role to reduce noises by radio receiving by a radio receiving antenna attached to a vehicle.

The conductor layers forming the bus bars 14, the heater wires 16 and the antenna wire 18 are preferably conductor layers made of the same material in view of a productivity and a cost.

The average line width of the conductor wires including the antenna wire 18 is preferably smaller than the average line width of the heater wires 16, and its ratio to the average line width of the heater wires 16 is more preferably at least 50% and less than 100%, further preferably from 60 to 80%. By the conductor wires having smaller line widths than the heater wires 16, the conductor wires are less likely to be noticeable when mounted to a vehicle, and the completeness in the outer appearance design will improve. Further, in a case where the line width of the conductor wire changes, the same effects as in the case of the heater wires except for the above will be expected.

Figure 3:
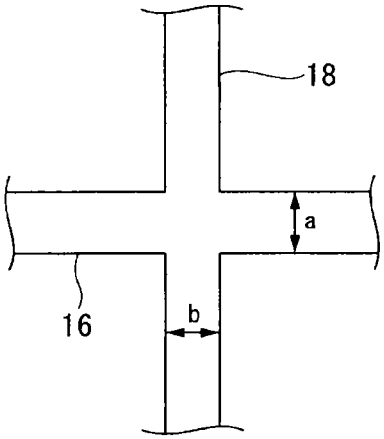
FIG. 3 is an enlarged view illustrating the embodiment of the window glass for a vehicle as shown in FIG. 1 at a point where a heater wire and a conductor wire intersect each other.

The window glass 1 for a vehicle is characterized in that the smallest line width "a" of the heater wires 16 (smallest value among line widths of the heater wires 16; hereinafter sometimes referred to simply as line width "a"; "a" in FIG. 3 represents the line width of the heater wire 16) is at most 0.4 mm, and the largest line width "b" of the antenna wire 18 in a range of intersection of the antenna wire 18 and the heater wire 16 (the largest value among line widths of the antenna wire 18; hereinafter sometimes referred to simply as line width "b"; "b" in FIG. 3 represents the line width of the antenna wire 18) is smaller than the above line width "a". The range of intersection of the antenna wire 18 and the heater wires 16 is a range in the antenna wire 18 from the intersection point closest to one end of the antenna wire 18 and the intersection point closest to the other end, among intersection points with the heater wires 16. Specifically, in this embodiment, it is a range between an intersection point c of the antenna wire 18 and the top heater wire 16 and an intersection point d of the antenna wire 18 and the bottom heater wire 16.

The line width "a" is preferably the smallest line width of the heater wires intersecting the conductor wire.

When the line width "a" of the heater wires 16 and the line width "b" of the antenna wire 18 satisfy the above conditions, the antenna wire 18 is less likely to be noticeable, and a good appearance will be achieved. The reason why such effects are obtained is as follows.

Figure 9:
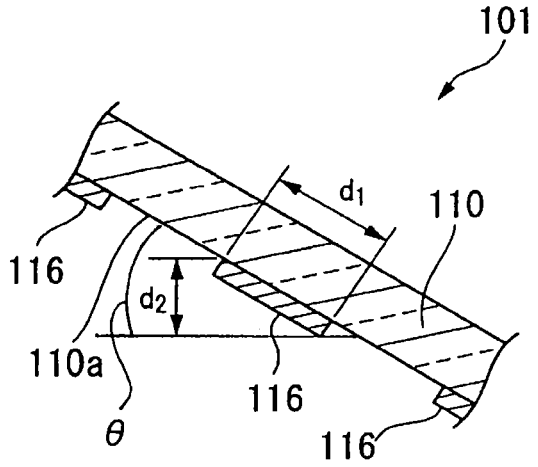
FIG. 9 is a view illustrating the practical line width and the apparent line width of the heater wire.

In a conventional window glass for a vehicle, usually the heater wires and the antenna wire are formed to have the same line width. Such a window glass for a vehicle is, particularly in the case of a rear glass of an automobile, mounted as tilted forward of a vehicle in many cases. For example, as shown in FIG. 9, a window glass 101 for a vehicle in which heater wires 116 are formed in the horizontal direction on the vehicle interior surface 110*a* of the glass main body 110 is mounted as tilted forward of a vehicle. In such a case, of the heater wires 116 formed in the horizontal direction on the vehicle interior surface 110*a* of the glass main body 110, the apparent line width $d_2$ is narrower than the actual line width $d_1$ as seen substantially horizontally by a passenger from the seat or the like or as seen from outside the vehicle. The relation between the apparent line width $d_2$ and the actual line width $d_1$ may be represented, for example, in the case of a rear glass, by $d_2=d_1 \sin\theta$, where the mounting angle θ to a vehicle body (the angle formed by a center line L and a horizontal plane (a plane in parallel with the ground surface), where the center line L is a line sequentially connecting the center points of the widths in a horizontal direction of the glass main body from the bottom side to the top side) is the angle of tilt forward of the vehicle.

Whereas, in the case of the antenna wire which is usually formed in a vertical direction at a right angle to the heater wires, its apparent line width as seen from the vehicle interior side or the vehicle exterior side is the same as the actual line width, since the line width in a horizontal direction does not change even if the window glass for a vehicle is mounted as tilted. That is, if the heater wires and the antenna wire intersecting the heater wires are formed with the same line width, when such a window glass for a vehicle is mounted as tilted, the antenna wire is relatively noticeable and looks thick apparently as compared with the heater wires.

In the case of conventional heater wires having not so small line widths and antenna wire intersecting the heater wires, even if the apparent line width $d_2$ of the heater wires and the apparent line width of the antenna wire intersecting the heater wires are different, the antenna wire is not noticeable. However, according to studies by the present inventor, it was found that in the case of very thin heater wires having an actual line width $d_1$ of at most 0.4 mm, if the line width of the antenna wire intersecting the heater wires is the same as the line width of the heater wires, the antenna wire is very noticeable. Thus, the present inventor has further conducted studies and as a result, found that the antenna wire may readily be made thin, although it is difficult to make the heater wires thin since it is necessary to secure the heat generation amount.

Therefore, in the window glass 1 for a vehicle, in addition to the line width "a" of the heater wires 16 of at most 0.4 mm, the line width "b" of the antenna wire 18 is made smaller than the line width "a" of the heater wires 16, whereby both the heater wires 16 and the antenna wire 18 are less likely to be noticeable, and the window glass 1 for a vehicle looks good, even if it is mounted as tilted.

In view of the compatibility with a conventional printing method such as screen printing and difficulty, the lower limit of the smallest line width "a" of the heater wires 16 is preferably 0.1 mm, more preferably 0.15 mm. Further, with a view to improving the appearance when the window glass is mounted to a vehicle, the upper limit of the line width "a" is preferably 0.4 mm, more preferably 0.3 mm, further preferably 0.2 mm.

In view of the compatibility with a conventional printing method such as screen printing and the difficulty, the lower limit of the largest line width b of the antenna wire 18 is preferably 0.07 mm, more preferably 0.1 mm, within a range smaller than the line width "a" of the heater wires 16. Further, when the line width "b" is at least the lower limit, the antenna wire 18 is less likely to be broken. Further, with a view to improving the appearance, the upper limit of the line width "b" is preferably 0.2 mm, more preferably 0.15 mm within a range smaller than the line width "a" of the heater wires 16.

The line width "b" of the antenna wire 18 preferably satisfies the condition of the following formula (1), whereby the antenna wire 18 is still less likely to be noticeable, and the appearance will further improve:

$$b \leq 0.7a \quad (1)$$

At that time, the mounting angle θ of the window glass 1 for a vehicle to the vehicle body is preferably θ≤30°, more preferably from θ≤20.5°, so as to achieve the above formula from the relation between the apparent line width $d_2$ and the actual line width $d_1$ thereby to achieve the apparent line width $d_2$ not to inhibit the field of view of the passenger. Whereas, if the mounting angle θ is too small, the transmission distortion of the window glass 1 for a vehicle tends to be noticeable, and the visibility will be lowered. In order to prevent such, θ is preferably 8°≤θ, more preferably 10°≤θ.

The window glass 1 for a vehicle may be used as e.g. a windshield, a rear glass, a side glass or a roof glass. Among them, the window glass 1 for a vehicle is particularly preferably used as a rear glass of an automobile, since the antenna wire 18 is hardly noticeable even if it is mounted as tilted and it has a good appearance.

(Production Process)

The window glass 1 for a vehicle may be produced, for example, by a process comprising the following steps (I) to (IV).

(I) A step of printing a black ceramic paste on a peripheral portion of the vehicle interior surface 10*a* on a glass main body 10 trimmed into a desired shape, followed by drying to form a frame-form black ceramic paste coating film.

(II) A step of printing a silver paste containing a silver powder and glass frit and as the case requires, a vehicle and additives on the surface of the vehicle interior surface 10*a* of the glass main body 10 and the black ceramic paste coating film in a predetermined pattern (a pattern containing bus bars 14, heater wires 16 and an antenna wire 18), followed by drying to form a silver paste coating film.

(III) A step of firing the silver paste coating film and the black ceramic paste coating film to form a black ceramic portion 12, bus bars 14, heater wires 16 and an antenna wire 18.

(IV) A step of soldering connection terminals to terminal connection portions of the bus bars 14.

(Step (I))

As a printing method in the step (I), a screen printing method or a gravure printing method may, for example, be mentioned. Among them, preferred is a screen printing method in that the black ceramic paste can easily be printed with a desired thickness on the surface of a large area glass main body 10 or a curved glass main body 10.

The drying temperature in the step (I) is preferably from 100 to 150° C.

The drying time in the step (I) is preferably from 5 to 20 minutes.

(Step (II))

As a printing method in the step (II), a screen printing method or a gravure printing method may, for example, be mentioned. Among them, preferred is a screen printing method in that the silver paste can easily be printed with a desired thickness on the surface of a large area glass plate or a curved glass plate.

The drying temperature in the step (II) is preferably from 100 to 150° C.

The drying time in the step (II) is preferably from 5 to 20 minutes.

(Step (III))

The firing temperature in the step (III) is preferably from 600 to 700° C.

The firing time in the step (III) is preferably from 2 to 5 minutes.

Firing of the silver paste coating film and the black ceramic paste coating film is carried out preferably simultaneously with bending of the glass plate. The bent (fired) glass main body 10 may be quenched by blowing cooling air to apply glass tempering heat treatment to the glass main body 10.

The bus bars 14, the heater wires 16 and the antenna wire 18 are formed preferably simultaneously by printing once and the following firing in view of the productivity and the cost.

(Step (IV))

Soldering of the connection terminals is carried out preferably by a method in which the glass main body 10 having the black ceramic portion 12, the bus bars 14, the heater wires 16 and the antenna wire 18 formed thereon is preheated, and connection terminals to which a solder alloy is preliminarily attached are soldered to the terminal connection portions of the preheated bus bars 14.

As a preheating method, a method of blowing hot air from a dryer, a heating method by a band heater, or a heating method by an infrared lamp heater may, for example, be mentioned.

The window glass for a vehicle of the present invention is not limited to the above embodiment.

For example, there are two or more antenna wires intersecting the heater wires. In a case where there are two or more antenna wires intersecting the heater wires, the line width "b" of each antenna wire satisfies the conditions described in the above embodiment. Preferred conditions are also the same.

Figure 4:
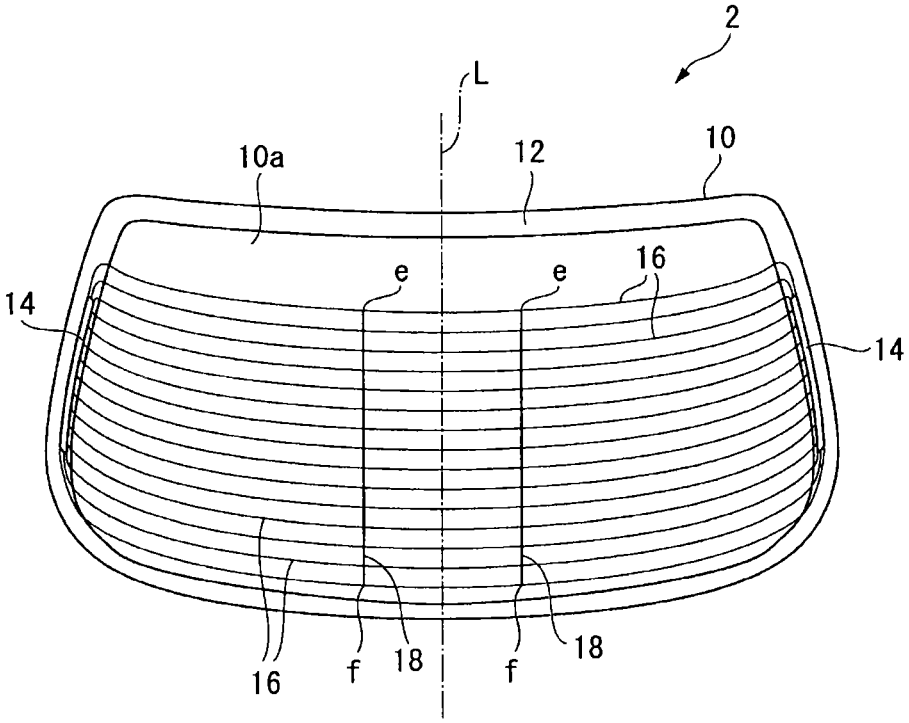
FIG. 4 is a front view illustrating another embodiment of the window glass for a vehicle of the present invention as seen from the vehicle interior side.

As a specific example of a window glass for a vehicle having two or more antenna wires intersecting the heater wires formed, a window glass 2 for a vehicle as shown in FIG. 4 may be mentioned. The same components of the window glass 2 (rear glass) for a vehicle as in the window glass 1 for a vehicle are represented by the same symbols and their expression is omitted. The window glass 2 for a vehicle is the same as the window glass 1 for a vehicle except that two antenna wires 18 are formed at the center portion in a horizontal direction of a glass main body 10 to intersect a plurality of heater wires 16.

The range of intersection of the heater wires 16 and the antenna wires 18 in the window glass 2 for a vehicle is a range from an intersection point e of each antenna wire 18 and the top heater wire 16 to an intersection point f of each antenna wire 18 and the bottom heater wire 16.

Further, in a case where two or more such antenna wires are formed, at least two such antenna wires are located preferably at a distance within 300 mm, more preferably within 200 mm, from the center point of the width in a horizontal direction of the glass main body. The distance from the center point of the width in a horizontal direction of the glass main body means a distance from the center point of the width of the glass main body at each position in the vertical direction from the bottom side to the top side of the glass main body when the window glass is mounted to the vehicle. That is, it is a distance in a horizontal direction between each of at least two antenna wires and the center line L, where the center line L is a line sequentially connecting center points of the width in a horizontal direction of the glass main body in the window glass for a vehicle, from the bottom side to the top side.

The center line L is, in a case where the glass main body is bilaterally symmetric, a line extending from the center of the bottom side of the glass main body vertically to the bottom side.

Figure 5:
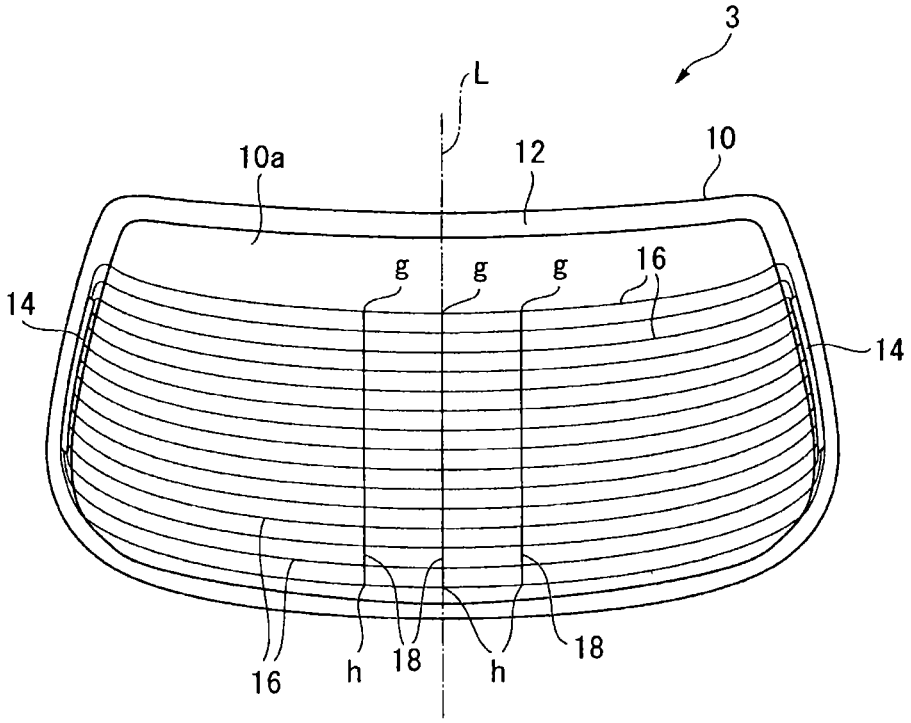
FIG. 5 is a front view illustrating another embodiment of the window glass for a vehicle of the present invention as seen from the vehicle interior side.

Further, a window glass 3 for a vehicle as shown in FIG. 5 may also be mentioned. The same components of the window glass 3 (rear glass) for a vehicle as in the window glass 1 for a vehicle are represented by the same symbols and their expression is omitted. The window glass 3 for a vehicle is the same as the window glass 1 for a vehicle except that three antenna wires 18 are formed at the center portion in a horizontal direction of a glass main body 10 to intersect a plurality of heater wires 16.

The range of intersection of the heater wires 16 and the antenna wires 18 in the window glass 3 for a vehicle is a range from an intersection point g of each antenna wire 18 and the top heater wire 16 to an intersection point h of each antenna wire 18 and the bottom heater wire 16.

In such a case also, at least two of such antenna wires 18 are located preferably at a distance from the center point of the width in a horizontal direction of the glass main body 10, i.e. a distance from the center line L in a horizontal direction, within 300 mm, more preferably within 200 mm.

Figure 6:
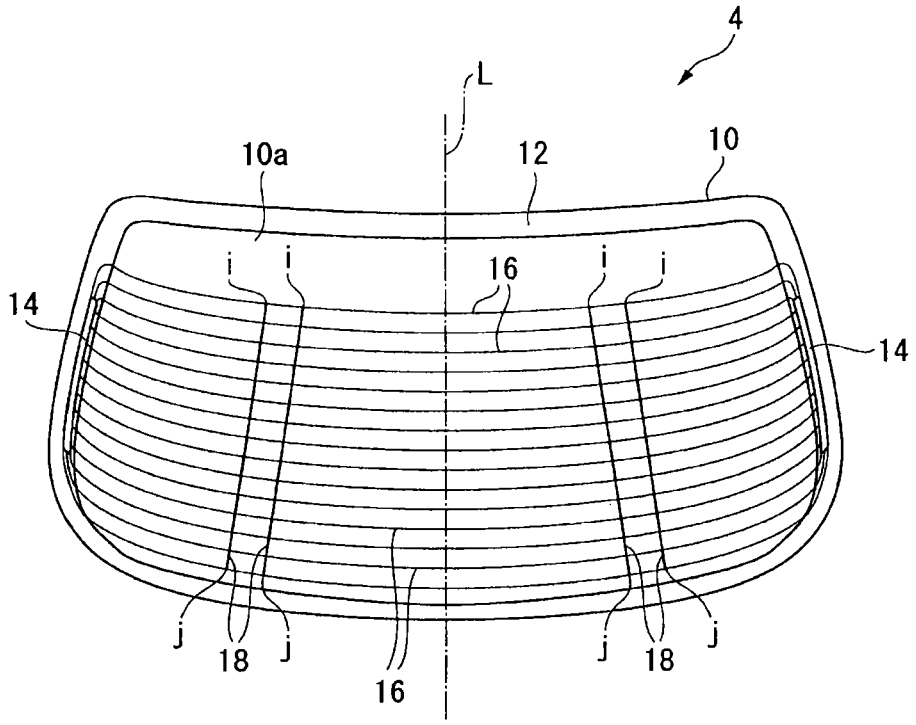
FIG. 6 is a front view illustrating another embodiment of the window glass for a vehicle of the present invention as seen from the vehicle interior side.

Further, a window glass 4 for a vehicle as shown in FIG. 6 may also be mentioned. The same components of the window glass 4 (rear glass) for a vehicle as in the window glass 1 for a vehicle are represented by the same symbols and their expression is omitted. The window glass 4 for a vehicle is the same as the window glass 1 for a vehicle except that two antenna wires 18 on each side in a horizontal direction of a glass main body 10, i.e. totally four antenna wires 18, are formed to intersect a plurality of heater wires 16.

The range of intersection of the heater wires 16 and the antenna wires 18 in the window glass 4 for a vehicle is a range from an intersection point i of each antenna wire 18 and the top heater wire 16 to an intersection point j of each antenna wire 18 and the bottom heater wire 16.

The antenna wires in such a case are also preferably formed to have e.g. the distance from the center line L within the above range.

Figure 7:
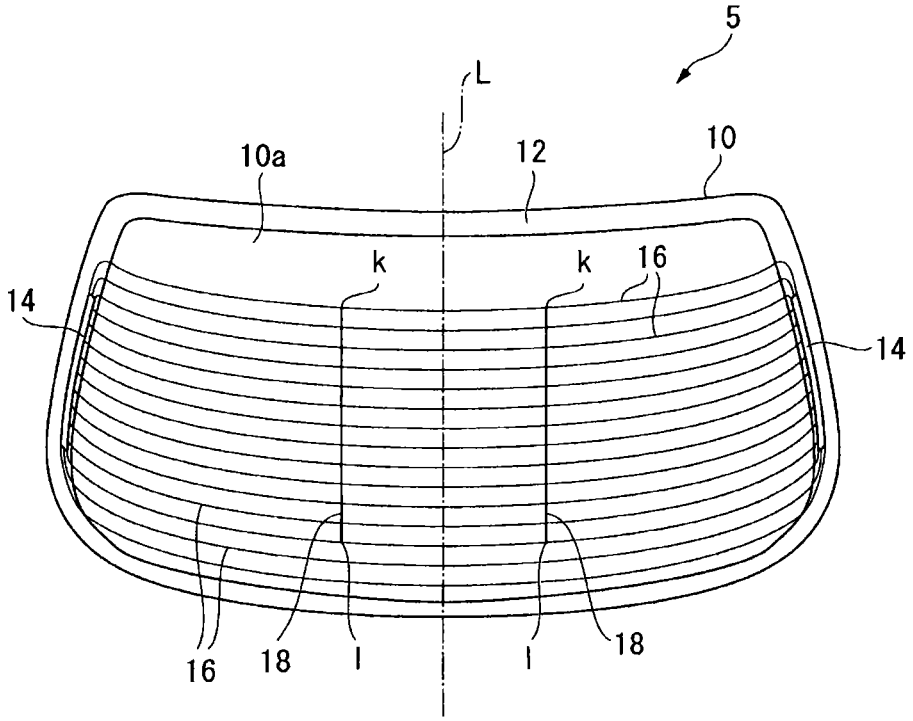
FIG. 7 is a front view illustrating another embodiment of the window glass for a vehicle of the present invention as seen from the vehicle interior side.

Further, the antenna wire may not be formed from the top heater wire to the bottom heater wire. Specifically, a window glass 5 for a vehicle as shown in FIG. 7 may be mentioned. The same components of the window glass 5 (rear glass) for a vehicle as in the window glass 1 for a vehicle are represented by the same symbols and their explanation is omitted. The window glass 5 for a vehicle is the same as the window glass 1 for a vehicle except that two antenna wires 18 are formed at the center portion in a horizontal direction to intersect heater wires 16 from the top to the third from the bottom.

The range of intersection of the heater wires 16 and the antenna wires 18 in the window glass 5 for a vehicle is a range from an intersection point k of each antenna wire 18 and the top heater wire 16 to an intersection point l of each antenna wire 18 and the third heater wire 16 from the bottom.

The antenna wires in such a case are also preferably formed to have e.g. the distance from the center line L within the above range.

Further, on the window glass for a vehicle of the present invention, in addition to the heater wires and the antenna wire for noise reduction as a conductor wire formed to intersect the heater wires, a radio receiving antenna wire may be formed.

Further, the conductor wire is not limited to the antenna wire and the heater wires but may be a circuit pattern to be used for e.g. a sensor such as a security sensor, and may include various conductor layers formed on a glass surface, such as a conductor pattern for car electronics such as ITC.

<Mounting Structure for Window Glass for Vehicle>

The mounting structure for the window glass for a vehicle of the present invention is a mounting structure wherein the window glass for a vehicle of the present invention is used as at least one member selected from the group consisting of a windshield, a rear glass, a side glass and a roof glass of an automobile, and it is mounted to an opening of an automobile by means of a resin molding.

The resin molding in the present invention is a member to be used to clog a gap between the window glass for a vehicle and the opening of an automobile, and includes not only so-called garnish formed by a hard resin and a so-called module assembly formed by injection molding of e.g. a thermoplastic resin but also a lip molding contacted with the opening of a vehicle, an insert member integrally mounted e.g. by injection molding as embedded in a module assembly, a decorative member, etc.

Figure 8:
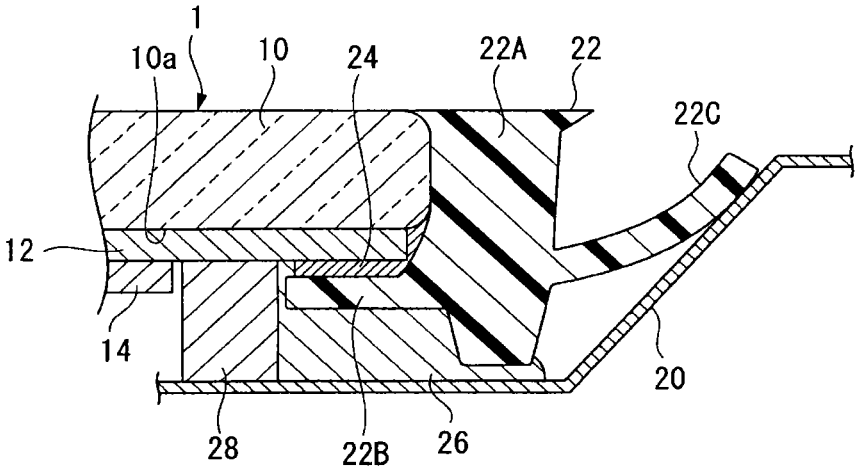
FIG. 8 is a cross sectional view illustrating the mounting structure for the window glass for a vehicle according to one embodiment of the present invention.

Now, as one example of the mounting structure for the window glass for a vehicle of the present invention, a mounting structure wherein the window glass 1 for a vehicle is mounted to an opening of an automobile, as shown in FIG. 8, will be described.

In this mounting structure, the vehicle interior surface 10*a* side of the window glass 1 for a vehicle is mounted to a body panel 20 around the opening of an automobile by means of a resin molding 22. The window glass 1 for a vehicle and the resin molding 22 are fixed by a black ceramic portion 12 on the vehicle interior surface 10*a* of the window glass 1 for a vehicle and the resin molding 22 being bonded by an adhesive 24. Further, the resin molding 22 and the body panel 20 are bonded and fixed by an adhesive 26. Further, to the body panel 20, a dam rubber 28 made of a rubber is provided so that the adhesive 26 will not extrude to the center side of the window glass 1 for a vehicle.

The shape of the resin molding 22 is not limited so long as it can clog a gap between the window glass 1 for a vehicle and the body panel 20. The resin molding 22 in this example comprises a main body portion 22A supporting a side edge portion of the window glass 1 for a vehicle, a flange portion 22B supporting the vehicle interior surface 10*a* side of the window glass 1 for a vehicle, and a lip portion 22C sealing a gap between the side edge portion of the window glass 1 for a vehicle and the body panel 20. In this Figure, an example (so-called two-sided adhesion) of a resin molding covering the vehicle interior surface and the side edge surface of the window glass 1 for a vehicle is shown, however, the peripheral portion of the vehicle exterior surface of the window glass 1 for a vehicle may also be covered (so-called three-sided adhesion), or the window glass 1 for a vehicle may be mounted so that only the vehicle interior surface is contacted (so-called one-sided adhesion).

The material of the resin molding 22 may, for example, be an elastic resin material such as TPO (an olefin-type thermoplastic elastomer), TPE (an ethylene-type thermoplastic elastomer) or PVC (polyvinyl chloride).

Each of the adhesive 24 to bond and fix the black ceramic portion 12 and the resin molding 22 and the adhesive 26 to bond and fix the resin molding 22 and the body panel 20 is preferably a urethane adhesive.

INDUSTRIAL APPLICABILITY

According to the present invention, it is possible to provide a window glass for a vehicle of which heater wires and a conductor wire intersecting the heater wires are not noticeable and which has a good appearance.

Further, according to the present invention, it is possible to provide a mounting structure for a window glass for a vehicle, wherein a window glass for a vehicle of which heater wires and a conductor wire intersecting the heater wires are not noticeable and which has a good appearance is mounted to an opening of an automobile.

This application is a continuation of PCT Application No. PCT/JP2013/078873, filed on Oct. 24, 2013, which is based upon and claims the benefit of priority from Japanese Patent Application No. 2012-235790 filed on Oct. 25, 2012. The contents of those applications are incorporated herein by reference in their entireties.

REFERENCE SYMBOLS

1 to 5: Window glass for a vehicle
10: Glass main body
10*a*: Vehicle interior surface
12: Black ceramic portion
14: Bus bar
16: Heater wire
18: Antenna wire
20: Body panel
22: Resin molding
24, 26: Adhesive

What is claimed is:

1. A window glass for a vehicle, comprising:

a glass main body;

a plurality of heater elements formed in wire-forms respectively such that the heater elements extend in a horizontal direction on an interior surface of the glass main body when mounted to the vehicle; and an antenna element formed in a wire-form such that the antenna element is intersecting at least one of the heater elements, wherein the heater elements have the smallest line width a that is at most 0.4 mm, and the antenna element has a range of intersection extending from one end of the antenna element to the other end of the antenna element and including at least one intersection point with the heater elements such that the largest line width b of the antenna element within the range of intersection is smaller than the line width a of the heater elements.

2. The window glass for a vehicle according to claim 1, wherein the line width b of the antenna element is at most 0.2 mm.

3. The window glass for a vehicle according to claim 1, wherein the antenna element and the heater elements satisfy $b \leq 0.7a$ where b represents the line width b of the antenna element, and a represents the line width a of the heater elements.

4. The window glass for a vehicle according to claim 1, wherein the line width a of the heater elements is at least 0.1 mm.

5. The window glass for a vehicle according to claim 1, wherein the antenna element is formed to intersect the plurality of heater elements and connecting isopotential points of the heater elements connected by the antenna element.

6. The window glass for a vehicle according to claim 1, wherein the antenna element is formed in a plurality such that the plurality of antenna elements intersects at least one of the heater elements, and at least two of the antenna elements are formed at a distance within 300 mm from a center point of a width in a horizontal direction of the glass main body.

7. The window glass for a vehicle according to claim 1, wherein the glass main body is a rear glass of an automobile.

8. The window glass for a vehicle according to claim wherein the smallest line width a of the heater elements is formed at an intersection point intersecting the antenna element.

9. The window glass for a vehicle according to claim 1, wherein the line width b of the antenna element is at least 0.07 mm.

10. The window glass for a vehicle according to claim 1, wherein the glass main body has a mounting angle θ of at most 30° where the mounting angle θ is an angle formed by a center line L and a horizontal line, and the center line L is a line sequentially connecting the center points of widths in a horizontal direction of the glass main body from a bottom side to a top side of the glass main body.

11. A mounting structure for the window glass for a vehicle as defined in claim 1, comprising:

a resin molding configured to mount the window glass of claim 1 to an opening of an automobile, wherein the window glass for a vehicle is one of a windshield, a rear glass, a side glass and a roof glass of an automobile.

12. The window glass for a vehicle according to claim 2, wherein the antenna element and the heater elements satisfy $b \leq 0.7a$ where b represents the line width b of the antenna element, and a represents the line width a of the heater elements.

13. The window glass for a vehicle according to claim 2, wherein the line width a of the heater elements is at least 0.1 mm.

14. The window glass for a vehicle according to claim 2, wherein the antenna element is formed to intersect the plurality of heater elements and connecting isopotential points of the heater elements connected by the antenna element.

15. The window glass for a vehicle according to claim 2, wherein the antenna element is formed in a plurality such that the plurality of antenna elements intersects at least one of the heater elements, and at least two of the antenna elements are formed at a distance within 300 mm from a center point of a width in a horizontal direction of the glass main body.

16. The window glass for a vehicle according to claim 2, wherein the glass main body is a rear glass of an automobile.

17. The window glass for a vehicle according to claim 2, wherein the smallest line width a of the heater elements is formed at an intersection point intersecting the antenna element.

18. The window glass for a vehicle according to claim 2, wherein the line width b of the antenna element is at least 0.07 mm.

19. The window glass for a vehicle according to claim 3, wherein the line width a of the heater elements is at least 0.1 mm.

20. The window glass for a vehicle according to claim 3, wherein the antenna element is formed to intersect the plurality of heater elements and connecting isopotential points of the heater elements connected by the antenna element.

* * * * *